US005284447A

United States Patent [19]

Kristiansen

[11] Patent Number: 5,284,447

[45] Date of Patent: Feb. 8, 1994

[54] CONTACT TERMINAL FOR MODULAR PLUG

[75] Inventor: Ralph Kristiansen, Roanoke, Va.

[73] Assignee: Virginia Plastics Company, Inc., Roanoke, Va.

[21] Appl. No.: 38,020

[22] Filed: Mar. 29, 1993

[51] Int. Cl.[5] ..... H01R 4/24

[52] U.S. Cl. ..... 439/425; 439/676

[58] Field of Search ..... 439/389–425, 439/676

[56] References Cited

U.S. PATENT DOCUMENTS 4,295,702 10/1981 Snyder ..... 439/425
4,412,715 11/1983 Bogese, II .
4,566,749 1/1986 Johnston ..... 439/425
4,717,217 1/1988 Bogese, II .
4,738,638 4/1988 Bogese, II .
4,767,355 8/1988 Phillipson et al. ..... 439/425
4,874,330 10/1989 Bogese, II et al. .

*Primary Examiner*—Joseph H. McGlynn
*Attorney, Agent, or Firm*—Saidman Designlaw Group

[57] ABSTRACT

A new and improved contact terminal for modular, telephone-style plugs. An elongated opening is provided in the central portion of the contact terminal for reducing capacitive coupling between contacts, resulting in better cross-talk isolation. Two parallel signal paths are also provided thereby, reducing signal reflections and improving the VSWR. A substantial savings in gold-plating is also provided by reducing the surface area of the contact terminal.

16 Claims, 2 Drawing Sheets

CONTACT TERMINAL FOR MODULAR PLUG

BACKGROUND OF THE INVENTION

1. Field of the Invention

This invention relates to electrical connectors and, more particularly, is directed towards a contact terminal for use in combination with a modular telephone-style plug.

2. Description of Related Art

Telephone-style modular plugs and jacks are well-known. They are used quite extensively in the telephone and communications industries, and for general interconnect purposes.

The modular plugs of the prior art typically utilize a plurality of side-by-side, substantially planar contact terminals to terminate a corresponding plurality of insulated wires.

A typical prior art contact terminal for such a modular plug is indicated generally by reference numeral 10 in FIG. 1. Contact terminal 10 (also referred to as a contact blade or contact pin) typically includes an upper body portion 11, a middle body portion 12 and a lower body portion 13. Each of the body portions 11, 12 and 13 include a central portion, located generally where the reference numerals 11, 12 and 13 are placed on FIG. 1. Typical contact terminals of the prior art are also described, for example, in U.S. Pat. Nos. 4,412,715 and 4,874,330, both of which are specifically incorporated herein by reference.

Still with reference to FIG. 1, the contact terminal 10 of the prior art is characterized by a pair of shoulders 14 and 16 which extend laterally from both sides of upper body portion 11. The purpose of shoulders 14 and 16 are to firmly seat the contact terminal 10 in a contact-receiving slot of the plug (not shown).

Upper body portion 11 also typically includes an upper, linear surface 18 for mating with a spring contact portion of the mating modular jack (not shown). Modular jacks which include conductors having spring contact portions are taught, for example, in U.S. Pat. Nos. 4,717,217 and 4,738,638, the disclosures of which are specifically incorporated herein by reference.

It may be appreciated that middle body portion 12 has a reduced width compared with upper and lower body portions 11 and 13.

Extending downwardly from lower body portion 13 are typically a pair of insulation-piercing tangs 20 and 22 which are adapted to pierce the insulation of an insulated wire (not shown) placed in the modular plug. An arch 28 is formed between tangs 20 and 22.

Still with reference to the prior art contact terminal 10 of FIG. 1, extending laterally at the approximate junction between middle and lower body portions 12 and 13 are a pair of teeth 24 which are designed to become embedded during installation in a terminal receiving slot (not shown) in the modular plug, all of which is very conventional. Teeth 24 therefore help maintain contact terminal 10 in place in the modular plug. An additional pair of teeth 26 are also provided in lower body portion 13.

Although the contact terminal 10 of the prior art generally functions quite well, as signal speeds increase on communication lines, the problem of unwanted cross-talk also increases. Data rates, for example, can go up to 50–200 mb per second. Cross-talk can be a significant problem at these data rates, and it would therefore be highly desirable if some mechanism were provided for minimizing such cross-talk.

In addition, it may be appreciated from FIG. 1 that the path of the signal from the input side (upper surface 18) down through the middle portion 12 and to the pair of tangs 20 and 22 is non-uniform. That is, the signal encounters a large mass at the upper body portion 11, a thinner but still substantial mass through the middle body portion 12, and splits at the arch 28 of lower body portion 13 into two portions finally being fed via tangs 20 and 22 into the insulated conductors (not shown) therebelow. Such non-uniform signal paths may contribute to undesirable reflections of the signal. It would be highly desirable if a way were found to reduce the likelihood of such undesirable reflections (thereby improving the VSWR) by providing a more uniform signal path.

Finally, the prior art contact terminal, although constructed of phosphor-bronze, must nevertheless be gold plated in order to provide sufficient reliability and contact integrity prior to installation in the plug. Since gold is a very expensive material, it would be highly desirable to provide ways for minimizing the quantity required.

OBJECTS AND SUMMARY OF THE INVENTION

A primary object of the present invention is to provide an improved contact terminal that overcomes the deficiencies noted above with respect to the prior art.

A further object of the present invention is to provide a contact terminal for use with modular telephone-style plugs which reduces cross-talk.

Another object of the present invention is to provide a contact terminal for use with a modular plug which provides a more uniform signal path, thereby minimizing reflection and improving the VSWR.

Another object of the present invention is to provide a contact terminal for use in a modular plug which reduces the amount of gold plating necessary for each terminal.

The foregoing and other objects and features are achieved in accordance with one aspect of the present invention through the provision of a contact terminal for use in combination with a modular telephone-style plug, comprising a substantially planar blade having upper, middle and lower body portions and a central portion. The middle body portion is of reduced width compared to the upper and lower body portions. The upper body portion typically includes a pair of shoulders that extend laterally from both sides thereof for seating the blade in the modular plug. An upper surface is also typically provided for making electrical contact with a spring contact of a mating modular jack. The lower portion typically includes a pair of tangs for piercing the insulation of an electrical wire located in the plug. The contact terminal of the present invention includes an opening formed in the central part of the blade and extending from the upper portion through the middle portion toward the lower portion. Alternatively, the opening may extend into the lower portion.

In accordance with another aspect of the present invention, the opening is shaped so as to provide a pair of parallel signal paths of substantially uniform width. More particularly, the opening may be of an oval or rectangular shape.

The opening in the contact terminal reduces cross-talk by reducing the capacitive coupling between adjacent contacts, which is achieved by reducing the total area thereof. Further, the opening reduces by approximately 10% the amount of gold plating needed for each contact terminal, a significant savings.

BRIEF DESCRIPTION OF THE DRAWINGS

The foregoing and other objects, aspects and features of the present invention will be more fully appreciated as the same becomes better understood when considered in connection with the detailed description of the present invention viewed in conjunction with the accompanying drawings, in which.

DETAILED DESCRIPTION OF THE PREFERRED EMBODIMENTS

Figure 2:
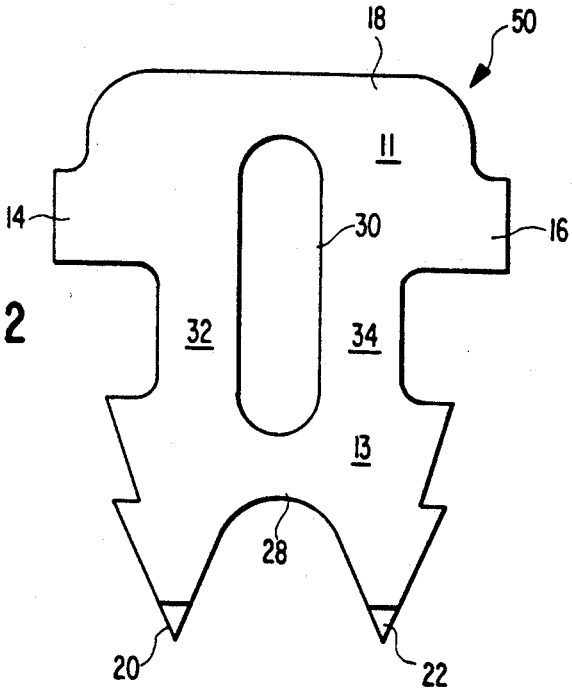
FIG. 2 is a side view illustrating a first preferred embodiment of the present invention.

Referring now to the drawings, wherein like reference numerals indicate identical or corresponding parts throughout the several views, and more particularly to FIG. 2 thereof, a preferred embodiment of the present invention is indicated generally by reference numeral 50.

Figure 1:
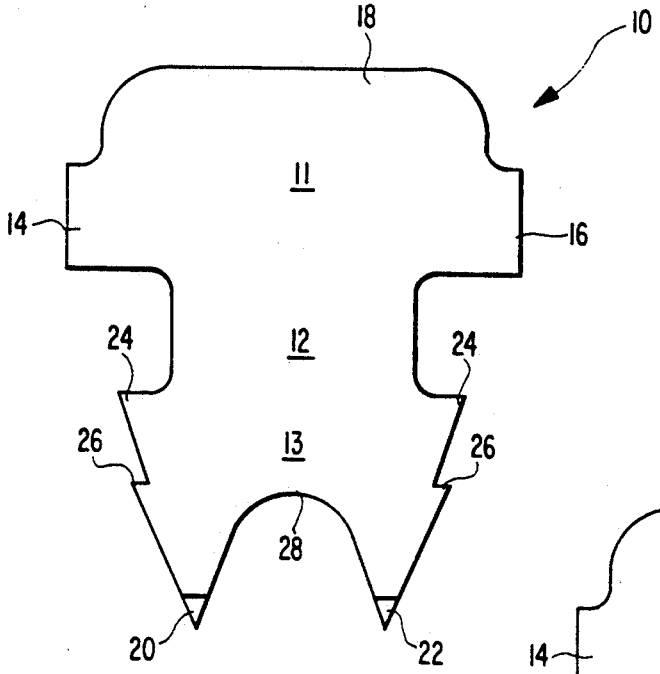
FIG. 1 PRIOR ART
FIG. 1 is a side view of a typical prior art contact terminal.

Contact terminal 50 is substantially identical to contact terminal 10 of FIG. 1, except that contact terminal 50 includes a cut-out or opening 30 that is formed in the central portion thereof. In the preferred embodiment shown in FIG. 2, opening 30 extends from the upper body portion 11 through the middle body portion 12 down to the lower body portion 13. Alternatively, the opening could extend just from upper body portion 11 through the middle body portion 12, stopping short of the lower body portion 13. Although the exact shape, size and location of opening 30 may be varied, the amount of material that is removed when forming cut-out 30 must be carefully controlled in order to preserve the structural integrity of contact terminal 50. That is, after formation of opening 30, contact terminal 50 must still be able to be press fit into place within a slot of the modular plug (to be described below) while tangs 20 and 22 pierce the insulation of the insulated wire and successfully make contact with the center conductor thereof.

Figure 4:
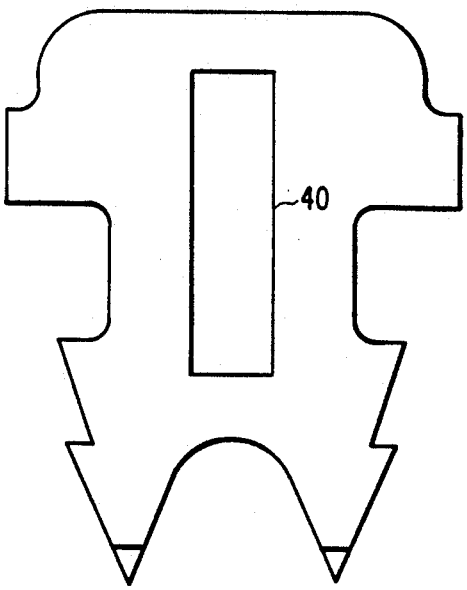
FIG. 4 illustrates an alternate embodiment of the present invention.

As shown in FIG. 2, opening 30 may be oval in shape; however, other shapes are possible, such as the rectangular shape 40 shown in FIG. 4, or other shapes (e.g., having irregular edges, or the like.

Referring back to FIG. 2, it may be appreciated that the formation of opening 30 produces a pair of parallel signal paths or strips 32 and 34. Parallel paths 32 and 34 enable the incoming signal from upper linear surface 18 to have two substantially uniform width signal paths through the upper, middle and lower body portions until the signal reaches tangs 20 and 22. These uniform width signal paths 32 and 34 minimize reflection, thereby resulting in a better VSWR.

In addition, formation of opening 30 reduces the total surface area between adjacent contacts, thereby reducing the capacitive coupling therebetween, resulting in more isolation from possible cross-talk.

Finally, the provision of a reduced surface area also substantially reduces the amount of gold plating required for the finished part, thereby providing a substantial (around 10%) cost savings.

Figure 3:
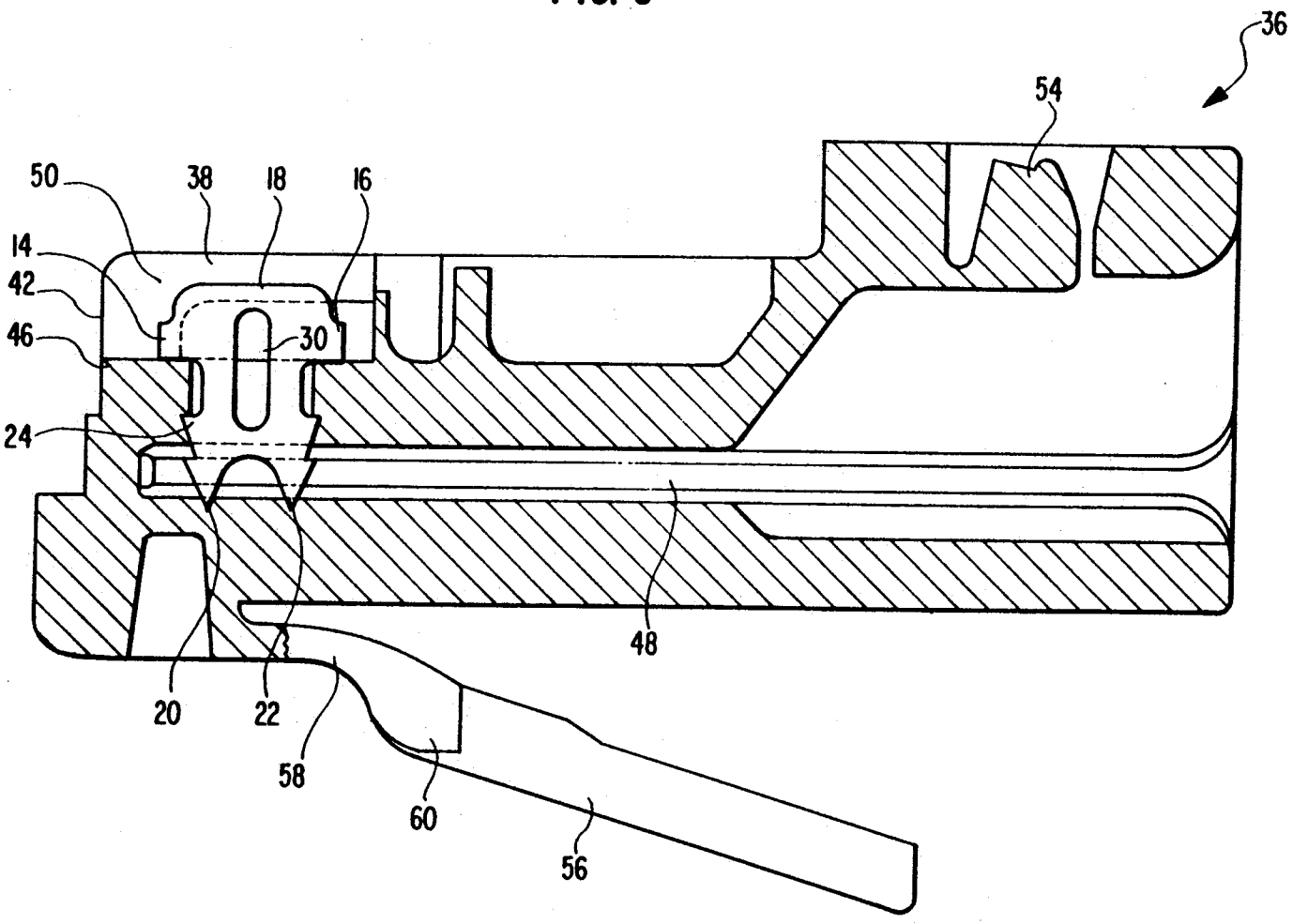
FIG. 3 is a longitudinal sectional view of a modular plug showing the first preferred embodiment of the present invention installed therein.

Referring now to FIG. 3, contact terminal 50 is illustrated installed in a modular plug housing 36, the latter of which is shown, however, without wire or cable. It will be appreciated by a person of ordinary skill in this art that a plurality of such contact terminals are positioned side-by-side in a plurality of terminal receiving slots 38 defined in turn by partitions 42 formed in the upper, terminal receiving side of plug 36.

The teeth 24 of contact terminal 50 are press fit within a reduced portion 44 of slot 38 until shoulders 14 and 16 come to rest on a ledge 46 of slot 38.

Modular plug housing 36 is also typically characterized by a cable-receiving cavity 52 which extends to a reduced-diameter cavity section 48 that receives insulated wires (not shown) from the cable in cavity 52. Above cavity 52 is typically positioned a snap-lock ledge 54 that pivots downwardly to provide strain relief for the cable in cavity 52, all of which is conventional.

As is also conventional, a locking tab or latching arm 56 is pivotally mounted as at 58 to housing 36 and extends obliquely rewardly thereof. Latching arm 56 includes spaced shoulders 60 adapted to be secured by similarly spaced shoulder-retaining or latch members in the mating modular jack.

It may be appreciated by virtue of the foregoing that I have provided a new and improved contact terminal for a modular telephone-style plug which includes an elongated opening that provides a more uniform width for each of the two signal paths from the upper surface of the contact blade to the two piercing tips, thereby improving the VSWR, minimizing cross-talk, and substantially reducing the amount of gold plating necessary.

Obviously, numerous modifications and variations of the present invention are possible in light of the above teachings. It is therefore to be understood that within the scope of the appended claims, the invention may be practiced otherwise than as specifically described herein.

I claim as my invention:

1. A contact terminal for use in combination with a modular telephone-style plug, comprising:
   - a substantially planar blade having upper, middle and lower body portions and a central portion;
   - said middle body portion being of reduced width compared to said upper and lower body portions;
   - said upper portion having a pair of shoulders extending laterally from both sides thereof for seating said blade in said plug, and an upper surface for making electrical contact with a spring contact of a mating modular jack;
   - said lower portion including a pair of tangs for piercing the insulation of an electrical wire located in said plug; and
   - an opening formed in the central part of said blade and extending from said upper portion through said middle portion toward said lower portion.

2. A contact terminal as set forth in claim 1, wherein said opening extends into said lower portion.

3. A contact terminal as set forth in claim 1, wherein said opening has an oval shape.

4. A contact terminal as set forth in claim 1, wherein said opening has a rectangular shape.

5. A contact terminal as set forth in claim 1, wherein said opening is shaped so as to provide a pair of parallel signal paths of substantially uniform width.

6. For use in combination with a modular telephone-style plug, a contact terminal of the type that includes a substantially planar blade having upper, middle and lower body portions and a central portion, said middle body portion being of reduced width compared to said upper and lower body portions, said upper portion having a pair of shoulders extending laterally from both sides thereof for seating said blade in said plug, and an upper surface for making electrical contact with a spring contact of a mating modular jack, said lower portion including a pair of tangs for piercing the insulation of an electrical wire located in said plug, the improvement comprising:

an opening formed in said central part of said blade and extending from said upper portion through said middle portion toward said lower portion.

7. A contact terminal as set forth in claim 6, wherein said opening extends into said lower portion.

8. The improvement as set forth in claim 6, wherein said opening has an oval shape.

9. The improvement as set forth in claim 6, wherein said opening has a rectangular shape.

10. The improvement as set forth in claim 6, wherein said opening is shaped so as to provide a pair of parallel signal paths of substantially uniform width.

11. A contact terminal for use in combination with a modular telephone-style plug, comprising:

a substantially planar blade having upper, middle and lower body portions and a central portion;

said upper portion having an upper surface for making electrical contact with a spring contact of a mating modular jack;

said lower portion including a pair of tangs for piercing the insulation of an electrical wire located in said plug; and means formed in said central portion of said blade for reducing the cross-talk between adjacent contact terminals.

12. A contact terminal as set forth in claim 11, wherein said cross-talk reducing means comprises an opening formed in said blade and extending from said upper portion through said middle portion toward said lower portion.

13. A contact terminal as set forth in claim 12, wherein said opening extends into said lower portion.

14. A contact terminal as set forth in claim 12, wherein said opening has an oval shape.

15. A contact terminal as set forth in claim 12, wherein said opening has a rectangular shape.

16. A contact terminal as set forth in claim 12, wherein said opening is shaped so as to provide a pair of parallel signal paths of substantially uniform width.

* * * * *